United States Patent [19]

Demizu et al.

[11] Patent Number: 4,943,506

[45] Date of Patent: Jul. 24, 1990

[54] WHITE TONER COMPRISING TITANIUM OXIDE OF SPECIFIED SIZE

[75] Inventors: Ichiro Demizu; Mitsutoshi Nakamura; Toshitaro Kohri, all of Osaka, Japan

[73] Assignee: Minolta Camera Kabushiki Kaisha, Osaka, Japan

[21] Appl. No.: 259,749

[22] Filed: Oct. 19, 1988

[30] Foreign Application Priority Data

| | | | |
|---|---|---|---|
| Oct. 19, 1987 | [JP] | Japan | 62-264214 |
| Oct. 19, 1987 | [JP] | Japan | 62-264211 |
| Oct. 19, 1987 | [JP] | Japan | 62-264213 |
| Oct. 19, 1987 | [JP] | Japan | 62-264215 |

[51] Int. Cl.[5] ..... G03G 9/08

[52] U.S. Cl. ..... 430/109; 430/110; 430/111

[58] Field of Search ..... 430/109, 110, 111

[56] References Cited

U.S. PATENT DOCUMENTS

| | | | |
|---|---|---|---|
| 4,312,932 | 1/1982 | Hauser et al. | 430/109 |
| 4,748,474 | 5/1988 | Kurematsu et al. | 430/111 |

FOREIGN PATENT DOCUMENTS

| | | |
|---|---|---|
| 61-256357 | 11/1986 | Japan . |
| 62-28772 | 2/1987 | Japan . |
| 62-105156 | 5/1987 | Japan . |

*Primary Examiner*—John L. Goodrow

*Attorney, Agent, or Firm*—Burns, Doane, Swecker & Mathis

[57] ABSTRACT

This invention provides white toners for use in forming images by dry process comprising titanium dioxide with 0.20–0.35 μm in mean particle size.

White toners of the invention are excellent in hiding properties and have no problem about toner flying, fogs and so on.

7 Claims, No Drawings

WHITE TONER COMPRISING TITANIUM OXIDE OF SPECIFIED SIZE

BACKGROUND OF THE INVENTION

This invention relates to a toner for electrophotographic reproduction by a dry developing process.

Copied images of electrophotography are black in general but in recent years, a reproduction machine capable of copying images in a color other than black has been introduced.

Among color-copied images, white-copied images are formed on a color copying paper, for example, on a black paper to have a striking contrast thereby providing images with visual beauty. White-copied images have a beauty different then black-copied images. White toners are constituted of pigments represented by titanium dioxide, binder resin and additives etc. When copied images are formed with white toners, hiding properties are particularly required. Hiding properties is defined as the power to hide a background such as copying paper when toners are fixed on the background. Black-copied images do not appear unclear even if the hiding properties are not so sufficient. But, white-copied images appear unclear even if white toners have hiding properties comparable to that of black toners. Conventional white toners have insufficient hiding power to form white images without showing an unclear appearance.

It is proposed to improve the hiding properties such that the content of white pigments, such as titanium dioxide, in white toners, are increased. The higher content of the pigment brings about problems such as the flying of toners or a poor resistance to the environment. It is thought that these problems result from poor dispersion properties of the pigments. The flying of toners causes fogs on copying paper and the poor environmental resistance causes the decrease of toner-charging properties. Further, alienated pigments cause poor cleaning properties.

SUMMARY OF THE INVENTION

An object of the invention is to provide white toners excellent in hiding properties, flying resistance, environmental resistance and cleaning properties.

The invention relates to white toner comprising titanium dioxide with 0.20–0.35 μm in mean particle size calculated from primary particles.

DETAILED DESCRIPTION OF THE INVENTION

The present invention provides toners excellent in hiding properties, toner-flying resistance, fog resistance and the like.

The present invention has accomplished the above objects by the incorporation of titanium dioxide as a pigment in toners.

That is, the present invention provides toners comprising titanium dioxide with 0.20–0.35 μm in mean particle size calculated from primary particles at the content of 15–60 parts by weight on the basis of 100 parts by weight of binder resin. Thereby the luminous reflectance is at least 20 % when the white toners are fixed on a black paper with 8% or less of refrectivity.

Titanium dioxide with 0.20 μm–0.35 μm, preferably 0.25 μm–0.30 μm in mean particle size is used as a white pigment. The use of titanium with the relatively bigger particle size than the conventional particle size of titanium makes it possible to provide copied images with higher hiding properties. The use of titanium dioxide as a white pigment with more than 0.35 μm in mean particle size results in the generation of fogs on a background such as copying paper because of its poor binding property with binder resin. If titanium dioxide is less than 0.20 μm or less, sufficient hiding power cannot be obtained. The mean particle size of titanium dioxide in the present invention is calculated from primary particles by means of an electron microscope.

Titanium dioxide may be produced by a method known as a sulfuric acid method, a chlorine method, on a vapor phase method. The crystal form of titanium dioxide may be anatase type, rutile type, or brookite type.

The content of titanium dioxide as a white pigment is 15–60 parts by weight, preferably 15–50 parts by weight, more preferably 20–40 parts by weight on the basis of 100 parts by weight of the resin described below. The content of less than 15 parts by weight results in poor hiding power. The content of more than 60 parts by weight results in poor binding property of the pigment with binder resin and poor dispersion properties, and affects adversely toner flying, fogs, fixing properties and the like.

The treatment of titanium dioxide with silicon oil, the coupling treatment of titanium dioxide, or the addition of aluminum oxide and/or silicon dioxide to titanium dioxide for inclusion in toners effects the improvement of enviromental resistance, and results in good dispersibility and the like.

Silicon oil for the treatment of titanium dioxide is exemplified by those known in the market, such as L-45, L-9000, L-31, Ocarsil EPS, L-305, L-404, L-494 (made by Nippon Yunika K.K.) or SH200, SH556, SH1107, SH3476, SH3747, SH3478, SH3749 or SH3771 (made by Toray Silicon K.K.).

A method of the treatment of titanium dioxide with silicon oil comprises dispersing titanium dioxide in a silicon oil dissolved solution, mixing and stirring the solution at the specified temperature for the specified time, and then separating titanium dioxide by an adequate means such as filtration, followed by drying it (solution dipping method). There is another method (spray drying method) wherein a silicon oil dissolved solution is sprayed over titanium dioxide and subjected to a drying treatment. First, a solution dipping method is described hereinafter.

A solvent for the silicon oil treatment is not particularly restricted so far as it is inactive to silicon oil and liable to be volatile, being exemplified by toluene, ethyl acetate, ethyl alcohol, water-ethyl alcohol, stearyl alcohol, flon, water-isopropyl alcohol.

The use of an organic solvent is necessarily a varied depending on the kind of silicon oil, but an organic solvent is generally used at the content of 10–5000 parts by weight, preferably 15–1000 parts by weight, more preferably 20–500 parts by weight on the basis of 1 part by weight of titanium dioxide. If the content is less than 10 parts by weight, the aggregation of titanium dioxide results in poor dispersibility of titanium dioxide in binder resin and it prevents leading the problem of toner flying to settlement. If the content of more than 5000 parts by weight dilutes the effects of the silicon oil treatment to our expectation.

A mixing ratio of silicon oil to titanium dioxide in the silicon oil treatment is necessarily varied depending on the kind of silicon oil, but silicon oil is admixed generally at 0.01–30 % by weight, preferably 0.05–20% by weight, more preferably 0.1–10% by weight to titanium dioxide. If the ratio is less than 0.01% by weight, the effects of silicon oil treatment can not be achieved sufficiently. If the ratio is more than 30% by weight, the aggregation of titanium dioxide results in poor dispersibility of titanium dioxide in binder resin and it prevents leading the problem of toner flying to settlement.

The temperature of silicon oil treatment is necessarily varied depending on the kind of applied organic solvent or silicon oil, but it is generally 10°–80° C., preferably 10°–70° C., more preferably 20°–60° C. If the temperature is higher than 80° C., the oil treatment cannot be carried out because of the evaporation of the solvents. If the temperature is lower than 10° C,. titanium dioxide is not treated sufficiently.

The time for silicon oil treatment (stirring and mixing time) is 0.01–12 hours, preferably 0.1–10 hours, more preferably 0.5–5 hours. If the time is shorter than 0.01 hour, titanium dioxide is not treated sufficiently. If the time is longer than 12 hours, the oil treatment cannot be carried out because of the evaporation of the solvents.

The same solution for a dipping method may be applied to a spray drying method. The conditions for spray drying are almost the same as those of the solution dipping method except that the concentration of silicon oil may be about one half as that of the solution dipping method within the usage of silicon oil above mentioned.

A coupling agent for coupling treatment is exemplified by a silane coupling agent, titanium coupling agent, aluminum coupling agent, zirco-alumi coupling agent. Any of these coupling agents may be used singly or in combination with another agent.

Silane coupling agents are exemplified by λ-glycidylpropyl trimethoxy silane, vinyl triacetoxy silane, methyl trimethoxy silane, vinyl tris(methoxyethoxy)silane, λ-chloropropyl trimethoxy silane, (3,3,3-trifluoropropyl)methyl dimethoxy silane, methyl triethoxy silane, vinyl triacetoxy silane, vinyl trimethoxy silane.

Titanium coupling agent are exemplified by tetra(2,2-diallyloxymethyl-1-buthyl) bis(di-tridecyl) phosphite titanate, tetraoctyl bis(ditridecylphosphite) titanate, isopropyl triisostearoyl titanate, isopropyl tridodecylbenzenesulfonyl titanate, isopropyl trioctanoyl titanate, dicumyl phenyloxyacetate titanate.

Aluminum coupling agent is exemplified by acetoalkoxy aluminum diisopropylate.

Zirco-aluminum coupling agent is exemplified by Cavco Mod M, Cavco Mod MPG, Cavco Mod MPM (made by Kyabudon Chemical K.K.)

A method of the coupling treatment of titanium dioxide with coupling agent comprises dispersing titanium dioxide in a coupling agent-dissolved solution, mixing and stirring the solution at the specified temperature for the specified time, and then separating titanium dioxide by an adequate means such as filtration, followed by drying it.

A solvent for the coupling treatment is not particularly restricted so far as it is inactive to coupling agents and liable to be volatile, being exemplified by cyclohexane, methylalcohol, ethylalcohol, water, toluene, isopropyl alcohol, acetone, and benzene.

The usage of an organic solvent is necessarily varied depending on the kind of coupling agent, but an organic solvent is generally used at the content of 10–5000 parts by weight, preferably 15–1000 parts by weight, more preferably 20–500 parts by weight on the basis of 1 part by weight of titanium dioxide. If the content is less than 10 parts by weight, the aggregation of titanium dioxide results in poor dispersibility of titanium dioxide in binder resin and it prevents leading the problem of toner flying to settlement. If the content of more than 5000 parts by weight dilutes the effects of the coupling treatment to our expectation.

A mixing ratio of coupling agent to titanium dioxide in the coupling treatment is necessarily varied depending on the kind of coupling agent, but coupling agent is admixed generally at 0.01–30% by weight, preferably 0.05–20% by weight, more preferably 0.1–10% by weight to titanium dioxide. If the ratio is less than 0.01% by weight, the effects of coupling treatment can not be achieved sufficiently. If the ratio is more than 30% by weight, the aggregation of titanium dioxide results in poor dispersibility of titanium dioxide in binder resin and it prevents leading the problem of toner flying to settlement.

The temperature of the coupling treatment is necessarily varied depending on the kind of applied organic solvents or coupling agents, but it is generally 10°–80 ° C., preferably 10°–70° C., more preferably 20°–60° C. If the temperature is higher than 80° C., the coupling treatment cannot be carried out because of the evaporation of the solvents. If the temperature is lower than 10° C., titanium dioxide is not treated sufficiently.

The time for the coupling treatment is 0.01–12 hours, preferably 0.1–10 hours, more preferably 0.5–5 hours. If the time is shorter than 0.01 hour, titanium dioxide is not treated sufficiently. If the time is longer than 12 hours, the coupling treatment can not be carried out because of the evaporation of the solvents.

When aluminum oxide and/or silicon dioxide are contained, its content is 0.05–20 parts by weight, preferably 0.5–15 parts by weight, more preferably 1–15 parts by weight on the basis of 100 parts by weight of binder resin. If the content is less than 0.05 part by weight, the effects are not sufficiently achieved. If the content is more than 20 parts by weight, the degree of whiteness is low.

Aluminum oxide and/or silicon dioxide, if contained, may be used singly or in combination with each other. Aluminum oxide and/or silicon dioxide may be mixed with white pigments to be fixed on the surfaces of white pigments in advance.

Preferred binder resin in thermoplastic resin which is exemplified by homopolymer of styrene or substituted styrene such as polystyrene, poly-p-chloro-styrene, poly-vinyltoluene; styryl copolymer such as styrene-p-chloro-styrene copolymer, styrene-propyrene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl d-chloromethacrylate copolymer; a copolymer of a styrene monomer such as styrene and substituted styrene, or an acrylic monomer such as acrylic acid, methacrylic acid, ester thereof with a vinyl monomer containing an amino group, a glycidyl group, a mercapto group, an ureido group, a quaternary ammonium group or a nitrogen-containing heterocyclic group (including quaternary compound); an other styryl copolymer such as styrene-acrylonitrile copolymer, styrene-vinyl methyl ether copolymer, styrene-vinyl ethyl ether copolymer, styrene-vinyl methyl ketone copolymer, styrene-butadiene copolymer, styrene-isoprene copolymer, styrene-acrylonitrile-indene copolymer, styrene-maleic acid copolymer or styrene-maleate copolymer; poly-methyl methacrylate; poly-butadiene-methacrylate; poly-vinyl chloride; poly-vinyl acetate; polyethylene; polypropyrene; polyester; polyurethane; polyamide; epoxy resin; poly-vinyl butyral; poly-acrylic acid resin; rosin; modified rosin; terpene resin; phenol resin; aliphatic hydrocarbon resin or alicyclic hydrocarbon resin; aromatic petroleum resin; or a mixture thereof; any of these resins can be used singly or in combination with other resin.

White toners of the present invention may contain other additives such as charge control agents, waxes and the like.

As to charge control agents, both positive and negative charge control agents may be used.

Typical examples of positive charge control agents which provide positive chargeability to toners are amino compounds, quaternary ammonium compounds, alkyl amides, phosphorous compounds, tungsten compound and the like. Typical examples of negative charge control agents which provide negative chargeability to toners are metal naphtenates, metal salts of fatty acid, reaction products of salicylic acid or derivatives thereof with metal salts, electron-acceptable compounds and the like. These charge control agents may be used singly or in combination with other agents to be mixed and dispersed in thermoplastic resin at the normal content of 1–20 parts by weight on the basis of 100 parts by weight of the resin.

As to waxes, a wax containing low molecular olefin polymer may be used.

Low molecular olefinic polymer has low molecular weight and may be a polymer constituted only of olefin monomers or an olefin copolymer constituted of olefin monomers and other monomers (not olefin).

Low molecular olefinic polymers are exemplified by a homopolymer with low molecular weight, copolymer and modified polymer thereof prepared by a monomer represented by the formula ;

$$CH_2{=}\underset{\underset{R}{|}}{CH}$$

wherein R is hydrogen or an $C_1$–$C_4$ alkyl group; such as polyethylene with low molecular weight, polypropylene, $\alpha$- or $\beta$-polybutylene, ethylene-propylene copolymer, polyethylene wax, oxidized polyethylene, and chloride thereof; random copolymer, block copolymer or graft copolymer which are mainly constituted of ethylene or propylene and modified by one or more kinds of ethylenically unsaturated monomer such as vinyl acetate, maleic anhydride, acrylic acid, ester thereof, methacrylic acid, ester thereof, acrylic amide, methacrylic amide, or acrylonitrile, methacrylonitrile.

Other examples of wax are natural wax such as vegetable wax, animal wax, solid wax and mineral wax, and other waxes such as higher fatty acid, derivatives thereof and the like.

Vegetable wax; candelilla wax, carnauba wax, rice wax, Japan wax, palm wax, auriculae wax, sugar corn wax, esbalt wax, bark wax, etc.

Animal wax; beeswax, lanoline, sharm wax, etc.

Mineral wax; montan wax, ozokerite, ceresin wax, etc.

Petroleum wax; paraffin wax, microcrystalline wax, petrolactum, etc.

Synthesized hydrocarbon; Fischer-Tropsch wax, sazol wax, derivatives thereof.

Modified wax; derivatives of montan wax, derivatives of paraffin wax, derivatives of microcrystalline, etc.

Hydrogenated wax; hardened castor oil, derivatives thereof, etc.

1,2-hydroxystearic acid, amide thereof, ester thereof, metallic soap thereof, etc.

Wax of amide series; saturated higher ($C_3$–$C_{22}$) fatty acid amide, unsaturated fatty acid amide, hydroxy fatty acid amide, N-methylol fatty acid amide, N,N'-methylene fatty acid amide N,N'-ethylene fatty acid amide, etc.

Fats and oils; dialkyl ketone of higher fatty acid, waxy fatty acid amine, imide and glyceride (acyl glycerol), etc.

Esters; monohydric alcohol-fatty acid ester, glycerol-fatty acid ester, glycol-fatty acid ester, sorbitane-fatty acid ester, polyoxyethylene-fatty acid ester, phthalate, etc.

Metal (alkali metal, alkali earth metal, zinc, aluminum) salts of higher fatty acid; calcium stearate, aluminum stearate, magnesium stearate, calcium palmitate, etc.

Hydrazide of higher fatty acid; palmitic acid hydrazide, stearic acid hydrazide, etc.

P-hydroxy anilide of higher fatty acid; p-hydroxy anilide of myristic acid, p-hydroxy anilide of stearic acid, etc.

Hydrochloride of $\beta$-diethylaminoethyl ester of higher fatty acid; hydrochloride of $\beta$-diethylaminoethyl laurate, hydrochloride of $\beta$-diethylaminoethyl stearate, etc.

Condensate of fatty acid amide with formaldehyde; a condensate of stearic acid amide-formaldehyde, a condensate of palmitic acid amide-formaldehyde, etc.

Petroleum residue; asphalt, gilsonite, etc.

Rubbers; nitrile rubber, chlorinated rubber, etc.

Halogenated hydrocarbon; halogenated paraffin, halogenated propylene, etc.

Hardened oils; hardened caster oil, hardened beef tallow oil, etc.

The waxes and so on above mentioned may be used singly or in combination with other ones or low molecular olefin polymers above mentioned.

Various kinds of components above mentioned are sufficiently mixed to obtain an uniformly mixed composition, followed by being kneaded. The kneaded mixture is left to stand for cooling, and pulverized with a grinder such as jet mill, classified in order to remove fine and coarse particles to obtain white toners of the invention with particle size of 5–25 $\mu$m (13–14 $\mu$m in mean particle size).

Toners of the invention may be further admixed externally with agents for fluidization. The agents for fluidization are exemplified by silica, aluminum oxide, titanium dioxide, a mixture of silica and aluminum oxide, a mixture of silica and titanium dioxide and the like.

White toners of the invention may be combined with for example, adequate carriers to prepare developers of two-component system. When developers of two component system are applied to a cascade developing method, glass beads coated with resin, steel particles and the like are used as carriers. When developers of a two component system are applied to magnetic brush, ferrite, fine iron particles, so called binder-type microcarrier and the like are used as carriers. On the other hand, white toners of the invention, which are non-magnetic toners, may be used singly by charging them with a developing sleeve.

This invention is explained by examples hereinafter.

SYNTHESIS EXAMPLE OF TITANIUM OXIDE

Titanium tetrachloride (guaranteed reagent; made by Kanto Chemicals Co.INC) of 50 g was dissolved in distilled water of 1 liter cooled to 4° C. in a beaker. The circumference of the beaker was cooled with ice water in order to prevent the exothermic heat generated by the dissolution of titanium tetrachloride. Then, ammonium aqueous solution (guaranteed reagent; made by Wako Jun-yaku Kogyo K.K.) was added gradually to the stirred solution in the beaker. The solution was kept at pH of 9–10 to precipitate white crystals. The particle size can be adjusted to a desired size in dependence on various stirring speed.

And then, after the resultant solution in the beaker was boiled with gas burner, precipitates were filtered. The filtrated materials were washed repeatedly until the solution used for washing the filtrated materials did not show the chlorine reaction with a titration of silver nitrate solution.

The resultant precipitated materials were dried at 107° C., further at 800° C. for 1 hour. Titanium dioxide of 400 g was obtained.

The obtained titanium was disintegrated with jet mills to get titanium dioxide with mean particle size shown below;

| No. | mean particle size |
|---|---|
| Titanium dioxide 1 | 0.27 μm |
| Titanium dioxide 2 | 0.34 μm |
| Titanium dioxide 3 | 0.30 μm |
| Titanium dioxide 4 | 0.25 μm |
| Titanium dioxide 5 | 0.18 μm |
| Titanium dioxide 6 | 0.30 μm |
| Titanium dioxide 7 | 0.20 μm |
| Titanium dioxide 8 | 0.33 μm |

SILICONE OIL TREATMENT EXAMPLE 1

Silicone oil SH 556 (made by Toray Silicone K.K.) of 3 g was admixed in toluene of 200 ml to be stirred for uniform dispersion in TK Homogenizer (made by Tokusyuki Kogyo K.K.) for 10 minutes. Titanium dioxide KR310 (mean particle size of 0.25 μm calculated from primary particles; made by Titan Kogyo K.K.) of 100 g was added slowly to the obtained dispersion solution, followed by being stirred for about 15 minutes. And then, titanium dioxide was filtered through a filter in vacuum, and subjected to hot-air drying at 30° C. for 3 hours and continuously to vacuum drying at 50°–60° C. for 5 hours, followed by being dispersed in TK Homogenizer under 2000 rpm for 5 minutes to obtain Titanium dioxide 9.

SILICONE OIL TREATMENT EXAMPLE 2

Titanium dioxide 10 was prepared similarly as Silicone oil treatment example 1, except that 0.05 g of Silicone oil SH556 (made by Toray Silicone K.K.) instead of 3 g of Silicone oil SH556 (made by Toray Silicone K.K.)

SILICONE OIL TREATMENT EXAMPLE 3

Titanium dioxide 11 was prepared similarly as Silicone oil treatment example 1, except that 30 g of Silicone oil SH556 (made by Toray Silicone K.K.) instead of 3 g of Silicone oil SH556 (made by Toray Silicone K.K.)

COUPLING TREATMENT EXAMPLE 1

Silane coupling agent SZ6070 (made by Toray Silicone K.K.) of 5 g was admixed in ethylalcohol of 250 ml to be stirred for uniform dispersion in TK Homogenizer (made by Tokusyuki Kogyo K.K.) for 10 minutes.

Titanium dioxide KR310 (made by Titan Kogyo K.K.) of 100 g was added slowly to the obtained dispersion solution, followed by being stirred for about 1 hour. And then, titanium dioxide was filtered through a filter in vacuum, and subjected to hot-air drying at 50°–60° C. for 3 hours and continuously to vacuum drying at 50°–60° C. for 5 hours, followed by being dispersed in TK Homogenizer under 2000 rpm for 5 minutes to obtain Titanium dioxide 12.

COUPLING TREATMENT EXAMPLE 2

Titanium dioxide 13 was prepared similarly as Coupling treatment example 1, except that 0.05 g of Silane coupling agent SZ6070 (made by Toray Silicone K.K.) instead of 5 g of Silane coupling agent SZ 6070(made by Toray Silicone K.K.)

COUPLING TREATMENT EXAMPLE 3

Titanium dioxide 14 was prepared similarly as Coupling treatment example 1, except that 30 g of Silane coupling agent SZ6070 (made by Toray Silicone K.K.) instead of 5 g of Silane coupling agent SZ 6070(made by Toray Silicone K.K.)

EXAMPLE 1

| ingredient | parts by weight |
|---|---|
| styrene-acrylic resin (Mw = 10500, Mw/Mn = 16.2, Tg = 61° C.) | 100 |
| titanium dioxide 1 (mean particle size of 0.27 μm) | 40 |
| styrene-dimethylaminoethyl methacrylate copolymer (60:40, Tg = 56° C., amine value = 174) | 4 |

These ingredients were sufficiently mixed in a henschel mixer. The mixture was kneaded with a biaxial extrusion kneader and left to stand for cooling. The kneaded materials were purvelized coarsely and then further purvelized with jet mill, followed by being classified to obtain toners with particle size of 5–25 μm (mean particle size of 13.5 μm).

The obtained toners were mixed with Aerosil R972 (hydrophobic silica; made by Nippon Aerosil K.K.) of 0.2 part by weight. The resultant toners were referred to as Toner 1.

EXAMPLE 2

Toner 2 (13.5 μm in mean particle size) was prepared similarly as Example 1 except that Titanium dioxide 2 of 15 parts by weight was used in stead of Titanium dioxide 1 of 40 parts by weight in Example 1.

EXAMPLE 3

Toner 3 (13.3 μm in mean particle size) was prepared similarly as Example 1 except that polyester resin of bisphenol A type (softening point of 121° C., Tg of 66° C.) of 100 parts by weight, and Titanium oxide 3 of 30 parts by weight were used.

EXAMPLE 4

Toner 4 (13.6 μm in mean particle size) was prepared similarly as Example 1 except that polyester resin of bisphenol A type (softening point of 123° C., Tg of 68° C.) of 100 parts by weight, and Titanium dioxide 4 of 30 parts by weight were used.

EXAMPLE 5

Toner 5 (13.6 μm in mean particle size) was prepared similarly as Example 3 except that Titanium dioxide 7 of 30 parts by weight was used instead of Titanium dioxide 3 of 30 parts by weight in Example 3.

EXAMPLE 6

Toner 6 (13.5 μm in mean particle size) was prepared similarly as Example 3 except that Titanium dioxide of 30 parts by weight was used in stead of Titanium dioxide 3 of 30 parts by weight in Example 3.

COMPARATIVE EXAMPLE 1

Toner 7 (13.2 μm in mean particle size) was prepared similarly as Example 1 except that Titanium dioxide 5 of 20 parts by weight were used instead of Titanium dioxide 1 of 40 parts by weight in Example 1.

COMPARATIVE EXAMPLE 2

Toner 8 (13.3 μm in mean particle size) was prepared similarly as Example 1 except that Titanium dioxide of 50 parts by weight were used instead of Titanium dioxide 1 of 40 parts by weight in Example 1.

COMPARATIVE EXAMPLE 3

Toner 9 (13.3 μm in mean particle size) was prepared similarly as Example 3 except that Titanium dioxide 6 of 30 parts by weight were used instead of Titanium dioxide 2 of 30 parts by weight in Example 3.

COMPARATIVE EXAMPLE 4

Toner 10 (13.6 μm in mean particle size) was prepared similarly as Example 1 except that Titanium dioxide 1 of 10 parts by weight were used instead of Titanium dioxide 1 of 40 parts by weight in Example 1.

COMPARATIVE EXAMPLE 5

Toner 11 (13.5 μm in mean particle size) was prepared similarly as Example 1 except that Titanium dioxide 1 of 65 parts by weight were used instead of Titanium dioxide 1 of 40 parts by weight in Example 1.

COMPARATIVE EXAMPLE 6

Toner 12 (13.4 μm in mean particle size) was prepared similarly as Example 1 except that Titanium dioxide 5 of 30 parts by weight were used instead of Titanium dioxide 1 of 40 parts by weight in Example 1.

EXAMPLE 7

| ingredient | parts by weight |
|---|---|
| styrene-acrylic resin (Mw = 16000, Mw/Mn = 13.4, Tg = 68° C.) | 100 |
| Titanium dioxide 9 | 40 |
| styrene-dimethylaminoethyl methacrylate copolymer (60:40, Tg = 56° C., amine value = 174) | 4 |

These ingredients were sufficiently mixed in a henschel mixer. The mixture was kneaded with a biaxial extrusion kneader and left to stand for cooling. The kneaded materials were purvelized coarsely and then further purvelized with jet mill, followed by being classified to obtain toners with particle size of 5–25 μm (mean particle size of 13.1 μm).

The obtained toners were mixed with Aerosil R972 (hydrophobic silica; made by Nippon Aerosil K.K.) of 0.2 part by weight. The resultant toner was referred to as Toner 13.

EXAMPLE 8

Toner 14 (13.3 μm in mean particle size) was prepared similarly as Example 7 except that Titanium dioxide 10 of 40 parts by weight was used in stead of Titanium dioxide 9 of 40 parts by weight in Example 7.

EXAMPLE 9

Toner 15 (13.5 μm in mean particle size) was prepared similarly as Example 7 except that Titanium dioxide 11 of 40 parts by weight was used in stead of Titanium dioxide 9 of 40 parts by weight in Example 7.

EXAMPLE 10

| ingredient | parts by weight |
|---|---|
| styrene-acrylic resin (Mw = 15400, Mw/Mn = 12.5, Tg = 64° C.) | 100 |
| Titanium dioxide 12 | 30 |
| styrene-dimethylaminoethyl methacrylate copolymer (60:40, Tg = 56° C., amine value = 174) | 4 |

These ingredients were sufficiently mixed in a henschel mixer. The mixture was kneaded with a biaxial extrusion kneader and left to stand for cooling. The kneaded materials were purvelized coarsely and then further purvelized with jet mill, followed by being classified to obtain toners with particle size of 5–25 μm (mean particle size of 13.5 μm).

The obtained toners were mixed with Aerosil R972 (hydrophobic silica; made by Nippon Aerosil K.K.) of 0.2 part by weight. The resultant toner was referred to as Toner 16.

EXAMPLE 11

Toner 17 (13.3 μm in mean particle size) was prepared similarly as Example 10 except that Titanium dioxide 13 of 30 parts by weight was used in stead of Titanium dioxide 12 of 30 parts by weight in Example 10.

EXAMPLE 12

Toner 18 (13.3 μm in mean particle size) was prepared similarly as Example 10 except that Titanium dioxide 14 of 30 parts by weight was used in stead of Titanium dioxide 12 of 30 parts by weight in Example 10.

EXAMPLE 13

| ingredient | parts by weight |
|---|---|
| Titanium dioxide (KR-310; made by Titan Kogyo K. K.) | 25 |
| $Al_2O_3$ made by Wako Jun-yaku Kogyo K. K.) | 10 |
| Bontron P-51 (made by Oriento Kagaku K. K) | 5 |
| styrene-n -butyl methacrylate copolymer (softening point; 132° C., Tg = 60° C.,) | 100 |

These ingredients were sufficiently mixed in a henschel mixer. The mixture was kneaded with a biaxial extrusion kneader and left to stand for cooling. The kneaded materials were purvelized coarsely and then further purvelized with jet mill, followed by being classified to obtain toners with particle size of 5–25 μm (mean particle size of 13.5 μm).

The obtained toners were mixed with Aerosil R972 (hydrophobic silica; made by Nippon Aerosil K.K.) of 0.2 part by weight. The resultant toner was referred to as Toner 19.

EXAMPLE 14

| ingredient | grams |
|---|---|
| Titanium dioxide (KR-310; made by Titan Kogyo K. K.) | 100 |
| $Al_2O_3$ (made by Wako Jun-yaku Kogyo K. K.) | 10 |

These ingredients were sufficiently mixed in a whirling blender (10000 rpm; 5 minutes) to fix $Al_2O_3$ on the surfaces of the titanium dioxide.

Toner 20 was prepared similarly as Example 13 except that the obtained titanium dioxide treated with $Al_2O_3$ was used instead of titanium dioxide and $Al_2O_3$ in the Example 13.

EXAMPLE 15

| ingredient | parts by weight |
|---|---|
| Titanium dioxide (KR-310; made by Titan Kogyo K. K.) | 25 |
| $SiO_2$ (made by Wako Jun-yaku Kogyo K. K.) | 10 |
| polyester resin (softening point 123° C., Tg = 65° C.) | 100 |

Toner 21 was prepared similarly as Example 13 using the above mentioned ingredients. The polyester resin was prepared as follows;

| | |
|---|---|
| polyoxypropylene(2.2)-2,2-bis(4-hydroxyphenyl)propane | 490 g, |
| polyoxyethylene(2.0)-2,2-bis(4-hydroxyphenyl)propane | 190 g, |
| terephthalic acid | 216 g, |
| n-dodecylsuccinic acid | 142 g, |
| dibutyltin oxide | 0.05 g |

These materials were put into a four-necked flask with the capacity of 1 liter equipped with a thermometer, a stirrer made of stainless steel, a falling type condenser and a nitrogen gas inlet, heated to 270° C. in a heating mantle and reacted under the nitrogen gas flow. When the flow out of water was stopped, trimellitic acid of 75 g was added to the mixture for further reaction. When the acid value became 30 mgKOH/g, the reaction mixture was cooled and the reaction was stopped.

The obtained polyester resin showed 30 mgKOH/g of acid value and 12 mgKOH/g of hydoxyl value. It showed also the softening point of Tm=123° C. measured by flow tester.

EXAMPLE 16

Toner 22 was prepared similarly as Example 15 except that $Al_2O_3$ of 5 parts of weight was further added.

EXAMPLE 17

| ingredient | grams |
|---|---|
| Titanium dioxide (KR-310; made by Titan Kogyo K. K.) | 30 |
| $Al_2O_3$ (made by Wako Jun-yaku Kogyo K. K.) | 0.1 |

Toner 23 was prepared similarly as Example 13 except that a mixture prepared by mixing above mentioned ingredients sufficiently in a whirling blender (10000 rpm; 5 minutes) instead of 25 parts by weight of titanium dioxide and 10 parts by weight of $Al_2O_3$ in Example 13.

EXAMPLE 18

Toner 24 was prepared similarly as Example 17 except that titanium dioxide of 30 g and $Al_2O_3$ of 20 g were used instead of titanium dioxide of 30 g and $Al_2O_3$ of 0.1 g in Example 17.

EXAMPLE 19

Toner 25 was prepared similarly as Example 17 except that titanium dioxide of 30 g and $SiO_2$ of 0.1 g were used instead of titanium dioxide of 30 g and $Al_2O_3$ of 0.1 g in Example 17.

EXAMPLE 20

Toner 26 was prepared similarly as Example 17 except that titanium dioxide of 30 g and $SiO_2$ of 20 g were used instead of titanium dioxide of 30 g and $Al_2O_3$ of 0.1 g in Example 17.

EXAMPLE 21

Toner 27 was prepared similarly as Example 17 except that titanium dioxide of 30 g, $Al_2O_3$ of 0.1 g and $SiO_2$ of 0.1 g were used instead of titanium dioxide of 30 g and $Al_2O_3$ of 0.1 g in Example 17.

EXAMPLE 22

Toner 28 was prepared similarly as Example 17 except that titanium dioxide of 30 g, $Al_2O_3$ of 10 g and $SiO_2$ of 10 g were used instead of titanium dioxide of 30 g and $Al_2O_3$ of 0.1 g in Example 17.

PREPARATION OF CARRIER (A)

PREPARATION OF CARRIER (A)

| ingredient | parts by weight |
|---|---|
| styrene-acrylic copolymer resin (Pliolite ALC; made by Good Year K. K.) | 100 |
| magnetic particles (Mapico Black 500; made by Metan Kogyo K. K.) | 200 |

-continued

| PREPARATION OF CARRIER (A) | |
|---|---|
| ingredient | parts by weight |
| carbon black (MA#8; made by Mitsubishi Kasei Kogyo K. K.) | 4 |
| silica (#200; made by Nippon Aerojil K. K.) | 2 |

The above-mentioned ingredients were sufficiently mixed in a ball mill, thereafter being kneaded over a three-rolls. The kneaded mixture was pulverized finely with a pin mill, followed by being air-classified to obtain Carrier (A) with 40 μm in mean particle size and $10^{14}$ Ω·cm in electrical volume resistance.

PREPARATION OF CARRIER (B)

| PREPARATION OF CARRIER (B) | |
|---|---|
| ingredient | parts by weight |
| polyester resin (softening point of 123° C., glass transition point of 65° C.) | 100 |
| inorganic magnetic particles (EPT-1000; made by Toda Kogyo K. K.) | 500 |
| carbon black (MA#8; made by Mitsubishi Kasei Kogyo K. K.) | 2 |

The above-mentioned ingredients were sufficiently mixed and pulverized in a henschel mixer, followed by being fused and kneaded in an extrusion kneader with cylinder parts set at 160° C. and cylinder head parts set at 150° C. The kneaded mixture was pulverized finely followed by being classified to obtain magnetic Carrier (B) with 55 μm in mean particle size. The resultant carriers showed powder electric resistance of $7.08\times10^{13}$ Ω·cm.

The resultant carrier showed magnetic flux density (Bm) of 1082 G, magnetization amount (σ) of 45.6 emu/g, residual magnetization (Hc) of 217.6 G under 1000 Oe of magnetic field.

CARRIER (C)

Coated carrier of ferrite type was referred to as Carrier (C) was used. Carrier (C) had 62 μm in mean particle size, and $5\times10^{11}$ Ω·cm (100 V/cm) in electric conductive resistance.

EVALUATION

White toners prepared in Examples 1–22, and Comparative examples 1–6 were respectively mixed with Carriers (A), (B), or (C) at the ratio of 10 wt% of the toners to prepare a developer. Then, charge amounts of toners were measured. The results were shown in Table 1.

Further, the hiding power of toners were evaluated by forming copied images with carrier (A)-containing developer (EXAMPLE 1–6, 13–22, COMPARATIVE EXAMPLE 1–6), carrier (B)-containing developer-(EXAMPLE 7–12) on copying paper with a copying machine EP450Z (for positive chargeable toners) or EP550Z (for negative chargeable toners)(made by Minolta Camera K.K.)

Further, the charge amounts of toners and the change of fogs on copying paper were evaluated by continuous developing process of 10000 sheets of copying paper.

The charge amount of toners were also measured after the resultant developers were left under conditions of high temperature and high humidity (35° C., 85%) for 2 days.

The obtained results were summarized in Table 2 and Table 3.

By the way, hiding power and fogs on copying paper were evaluated and ranked as described below;

HIDING POWER

Hiding power means the power to hide a ground of copying paper when toners are fixed on the ground. There are various kinds of methods of measurements of hiding power, among which the luminous reflectance was adopted to evaluate the hiding power. The luminous reflectance was evaluated when toners were fixed on black paper with less than 8% of reflectivity. The luminous reflectance of less than 20% was showed as the symbol "x", the luminous reflectance of 20% or more was shown as the symbol "o".

The measurement of the luminous reflectance was carried out with a spectrophotometer for visible-ultraviolet light (UVIDEC-610B; made by Nippon Densi K.K.)

FOGS ON COPYING PAPER

Fogs on copying paper caused by toner flying were evaluated visually to be ranked as

| | |
|---|---|
| o | good (without fogs) |
| Δ | without no problem |
| x | poor |

TABLE 1

| | Carrier A (μC/g) | Carrier B (μC/g) | Carrier C (μC/g) | titanium oxide mean particle size (μm) | loads (parts by weight) |
|---|---|---|---|---|---|
| Example | | | | | |
| 1 | +14.4 | +14.7 | +12.9 | 0.27 | 40 |
| 2 | +13.0 | — | — | 0.34 | 15 |
| 3 | −12.6 | — | — | 0.30 | 30 |
| 4 | −13.4 | — | — | 0.25 | 60 |
| 5 | −13.6 | — | — | 0.20 | 30 |
| 6 | −12.8 | — | — | 0.33 | 30 |
| 7 | +12.8 | +13.3 | +14.1 | 0.25 | 40 |
| 8 | — | +12.9 | — | 0.25 | 40 |
| 9 | — | +12.0 | — | 0.25 | 40 |
| 10 | +13.3 | +12.6 | +12.1 | 0.25 | 30 |
| 11 | — | +11.8 | — | 0.25 | 30 |
| 12 | — | +11.5 | — | 0.25 | 30 |
| 13 | +13.5 | +14.0 | +14.1 | 0.25 | 25 |
| 14 | +13.8 | — | — | 0.25 | 23 |
| 15 | −12.8 | — | — | 0.25 | 25 |
| 16 | −12.0 | — | — | 0.25 | 25 |
| 17 | +14.3 | — | — | 0.25 | 25 |
| 18 | +13.6 | — | — | 0.25 | 15 |
| 19 | +14.2 | — | — | 0.25 | 25 |
| 20 | +13.5 | — | — | 0.25 | 15 |
| 21 | +14.0 | — | — | 0.25 | 25 |
| 22 | +13.0 | — | — | 0.25 | 15 |
| Comparative Example | | | | | |
| 1 | +15.1 | — | — | 0.18 | 20 |
| 2 | +11.8 | — | — | 0.18 | 65 |
| 3 | −11.5 | — | — | 0.36 | 30 |
| 4 | +15.2 | — | — | 0.27 | 10 |
| 5 | +11.7 | — | — | 0.27 | 65 |
| 6 | +14.9 | — | — | 0.18 | 30 |

TABLE 2

| | hiding power | fogs on copying paper initial | fogs on copying paper after 10000 sheets | charge amount (μC/g) initial | charge amount (μC/g) after 10000 sheets |
|---|---|---|---|---|---|
| EXAMPLE | | | | | |
| 1 | O | O | O | +14.4 | +12.2 |
| 2 | O | O | O | +13.0 | +11.9 |
| 3 | O | O | O | −12.6 | −11.5 |
| 4 | O | O | O | −13.4 | −11.8 |
| 5 | O | O | Δ | −13.6 | −11.0 |
| 6 | O | O | Δ | −12.8 | −10.7 |
| COMPARATIVE EXAMPLE | | | | | |
| 1 | X | O | O | +15.1 | +13.7 |
| 2 | X | X | X | +11.8 | +10.4 |
| 3 | O | X | X | −11.5 | −10.0 |
| 4 | X | O | O | +15.2 | +14.1 |
| 5 | O | X | X | +11.7 | +10.6 |
| 6 | X | O | O | +14.9 | +11.6 |

TABLE 3

| EXAMPLE | hiding power | fogs on copying paper initial | fogs on copying paper after 10000 sheets | charge amount (μC/g) initial | charge amount (μC/g) after 10000 sheets | charge amount (μC/g) after high temp. and humid. |
|---|---|---|---|---|---|---|
| 7 | O | O | O | +13.3 | +12.5 | +12.2 |
| 8 | O | O | Δ | +12.9 | +11.1 | +10.4 |
| 9 | O | O | Δ | +12.0 | +10.8 | +9.8 |
| 10 | O | O | O | +12.6 | +12.0 | +10.8 |
| 11 | O | O | Δ | +11.8 | +10.1 | +9.6 |
| 12 | O | O | Δ | +11.5 | +9.9 | +9.3 |
| 13 | O | O | O | +13.5 | +13.0 | +12.5 |
| 14 | O | O | O | +13.8 | +13.5 | +13.0 |
| 15 | O | O | O | −12.8 | −12.0 | −11.5 |
| 16 | O | O | O | −12.0 | −11.5 | −11.2 |
| 17 | O | O | O | +14.3 | +12.9 | +13.3 |
| 18 | O | O | O | +13.6 | +13.1 | +12.0 |
| 19 | O | O | O | +14.2 | +13.4 | +11.9 |
| 20 | O | O | O | +13.5 | +12.8 | +11.1 |
| 21 | O | O | O | +14.0 | +13.5 | +11.5 |
| 22 | O | O | O | +13.0 | +12.0 | +10.4 |

What we claim is:

1. White toner for use in forming images by dry process comprising binder resin and titanium dioxide with 0.20–0.35 μm in mean particle size at the content of 15–60 parts by weight on the basis of 100 parts by weight of the binder resin; the luminous reflectance is at least 20% when the white toner is fixed on a black paper with 8% or less of reflectivity.

2. White toner for use in forming images by dry process comprising binder resin and titanium dioxide which is treated with silicon oil prior to mixing with said binder resin, said titanium dioxide with 0.20–0.35 μm in mean particle size at the content of 15–60 parts by weight on the basis of 100 parts by weight of the binder resin; the luminous reflectance is at least 20% when the white toner is fixed on a black paper with 8% or less of reflectivity.

3. White toner of claim 2, wherein the titanium dioxide is treated with silicon oil at 0.01–30% by weight of the additional ratio of silicon oil to titanium dioxide.

4. White toner for use in forming images by dry process comprising binder resin and titanium dioxide which is treated with a coupling agent prior to mixing with said binder resin, said titanium dioxide with 0.20–0.35 μm in mean particle size at the content of 15–60 parts by weight on the basis of 100 parts by weight of the binder resin; the luminous reflectance is at least 20% when the white toner is fixed on a black paper with 8% or less of reflectivity.

5. White toner of claim 2, wherein the titanium dioxide is treated with a coupling agent at 0.01–30% by weight of the additional ratio of the coupling agent to titanium dioxide.

6. White toner for use in forming images by dry process comprising binder resin and titanium dioxide with 0.20–0.35 μm in mean particle size at the content of 15–60 parts by weight on the basis of 100 parts by weight of the binder resin, aluminum oxide and/or silicon dioxide; the luminous reflectance is at least 20% when the white toner is fixed on a black paper with 8% or less of reflectivity.

7. White toner of claim 6, wherein aluminum oxide and/or silicon dioxide are fixed on the surface of titanium dioxide prior to mixing with said binder resin.

* * * * *